US009907403B2

(12) United States Patent
Lin et al.

(10) Patent No.: US 9,907,403 B2
(45) Date of Patent: Mar. 6, 2018

(54) ARMREST ASSEMBLY FOR A CHAIR

(71) Applicant: Pao Shen Enterprises Co., Ltd., Chang Hua (TW)

(72) Inventors: Chen-Yu Lin, Chang Hua (TW); Jung-Feng Chen, Chang Hua (TW)

(73) Assignee: Pao Shen Enterprises Co., Ltd., Ta Sun Hsiang, Chang Hua (TW)

( * ) Notice: Subject to any disclaimer, the term of this patent is extended or adjusted under 35 U.S.C. 154(b) by 3 days.

(21) Appl. No.: 15/338,803

(22) Filed: Oct. 31, 2016

(65) Prior Publication Data

US 2018/0020834 A1 Jan. 25, 2018

(30) Foreign Application Priority Data

Jul. 22, 2016 (TW) ..... 105123138 A

(51) Int. Cl.
*A47C 7/54* (2006.01)
*A47C 1/03* (2006.01)

(52) U.S. Cl.
CPC . *A47C 1/03* (2013.01); *A47C 7/54* (2013.01)

(58) Field of Classification Search
CPC ..... A47C 1/03; A47C 7/54; B60N 2/4626; B60N 2/466
See application file for complete search history.

(56) References Cited

U.S. PATENT DOCUMENTS 6,843,534 B2 * 1/2005 Lee ..... A47C 7/54 297/411.35
7,201,449 B2 * 4/2007 Tsai ..... A47C 1/03 297/411.36
7,387,341 B1 * 6/2008 Tsai ..... A47C 1/03 297/411.35
9,004,603 B1 * 4/2015 Wang ..... A47C 1/03 297/411.35
9,039,087 B2 * 5/2015 Lee ..... A47C 7/54 297/353
9,320,360 B2 * 4/2016 Bauer ..... A47C 1/03

FOREIGN PATENT DOCUMENTS

| | | |
|---|---|---|
| CN | 202020085 U | 11/2011 |
| TW | 393960 U | 6/2000 |
| TW | M383341 | 7/2010 |
| TW | I353822 | 12/2011 |
| TW | I414256 | 11/2013 |

OTHER PUBLICATIONS

TW search report in corresponding TW application No. 105123138 dated Jun. 25, 2017 (2 pages).

* cited by examiner

*Primary Examiner* — Philip F Gabler
(74) *Attorney, Agent, or Firm* — Trop Pruner & Hu, P.C.

(57) ABSTRACT

An armrest assembly includes a mounting plate disposed on a support column and having an elongated moving slot for a first pivot shaft to movably extend therethrough, an armrest plate having a sliding slot elongated transverse to the moving slot such that the first and second pivot shafts extend through and are slidable along the sliding slot to allow the armrest plate to be horizontally movable and turnable relative to the mounting plate, and a retaining unit disposed to produce a magnetically attractive force that generates resistance against a relative movement of the armrest plate to the mounting plate.

10 Claims, 13 Drawing Sheets

ARMREST ASSEMBLY FOR A CHAIR

CROSS-REFERENCE TO RELATED APPLICATION

This application claims priority of Taiwanese Patent Application No. 105123138, filed on Jul. 22, 2016.

FIELD

The disclosure relates to an armrest assembly for a chair, and more particularly to an adjustable armrest assembly mounted on a side of a chair.

BACKGROUND

Conventional armrests are generally mounted on two opposite sides of a chair. It is desirable that the armrests are adjustable to be positioned to suit an individual user. An adjustable armrest is disclosed in U.S. Publication No. 2003/0030317 A1 and allows a user to adjust the horizontal position and orientation thereof. With a horizontally slidable seat and a linkage pivotally connected to the slidable seat, and with engagement between a protrusion which is mounted on the slidable seat and a selected one of cavities formed in the linkage, a rest surface of the armrest is retained at a desired position and orientation. However, since the position and orientation of the rest surface depend on the engagement of the protrusion with the selected cavity, the selections available to a user are limited, and the armrest cannot be freely adjusted for meeting the requirements of different users.

SUMMARY

Therefore, an object of the disclosure is to provide an armrest assembly that can alleviate at least one of the drawbacks of the prior art.

According to the disclosure, the armrest assembly includes a support column, a mounting plate disposed on the support column, and having a first moving slot which is elongated in a first direction, and a pivotal unit including first and second pivot shafts which are aligned with each other in a second direction that is transverse to the first direction. The first pivot shaft extends through the first moving slot and is movable relative to the mounting plate in the first direction. The second pivot shaft is disposed on the mounting plate. An armrest plate has a sliding slot which is elongated in the second direction and through which the first and second pivot shafts extend to be slidable in the second direction so as to permit the armrest plate to be movable relative to the mounting plate in the second direction and to be turnable about the second pivot shaft. A retaining unit includes at least one retaining module which is mounted on the pivotal unit, and a retaining plate which is disposed adjacent to the retaining module and which is configured to cooperate with the retaining module to produce a magnetically attractive force that generates resistance against a relative movement between the retaining module and the retaining plate to resist a movement of the armrest plate relative to the mounting plate.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
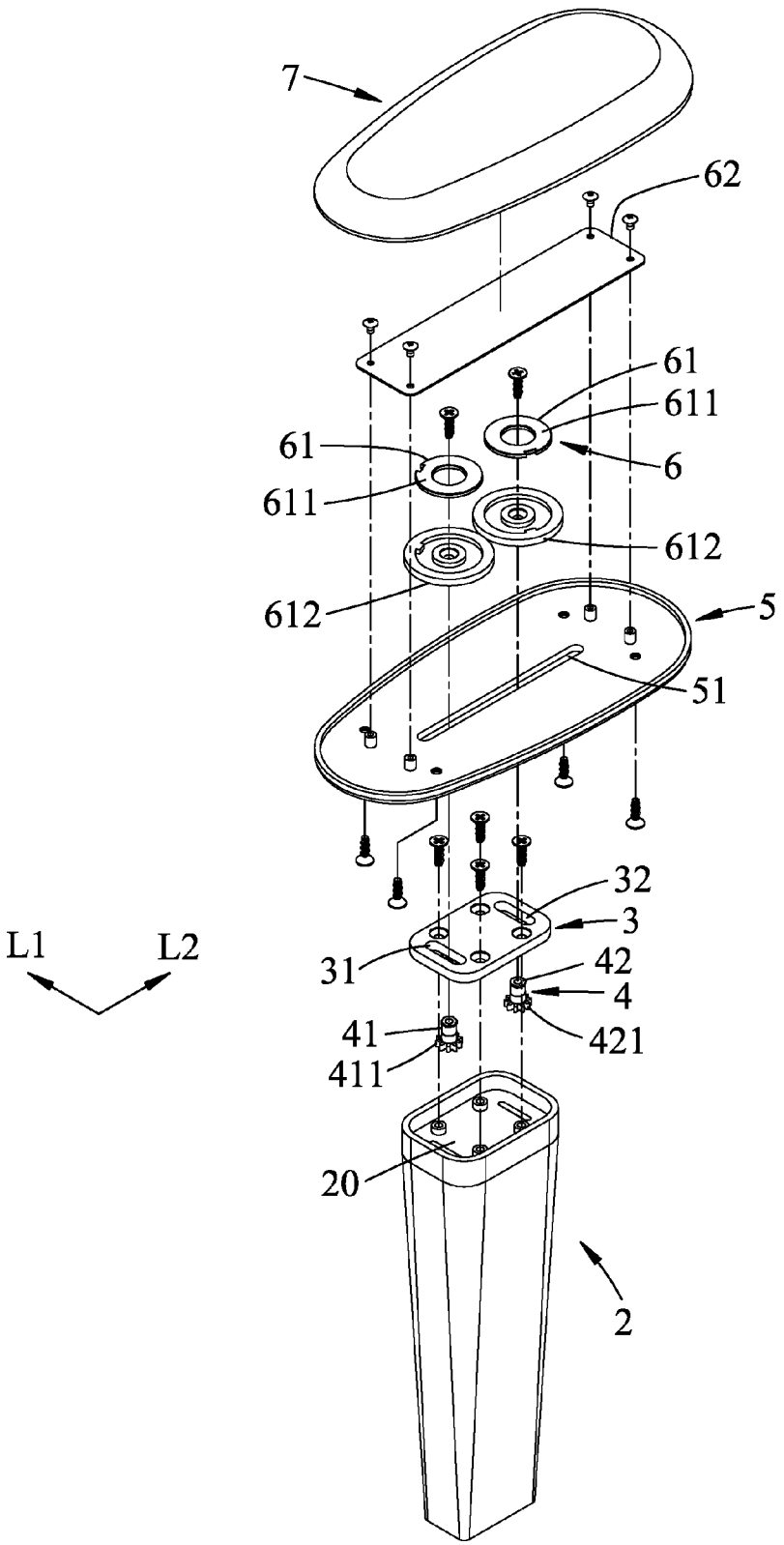
FIG. 1 is an exploded perspective view illustrating an embodiment of an armrest assembly according to the disclosure.

Before the disclosure is described in greater detail, it should be noted that where considered appropriate, reference numerals or terminal portions of reference numerals have been repeated among the figures to indicate corresponding or analogous elements, which may optionally have similar characteristics.

Figure 2:
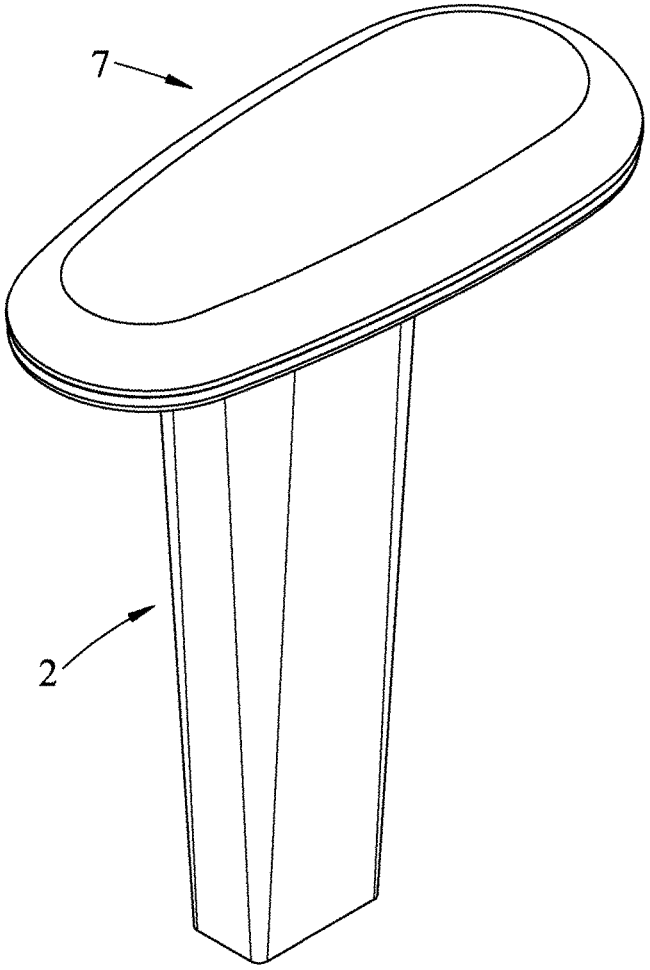
FIG. 2 is a perspective view of the embodiment.
Figure 3:
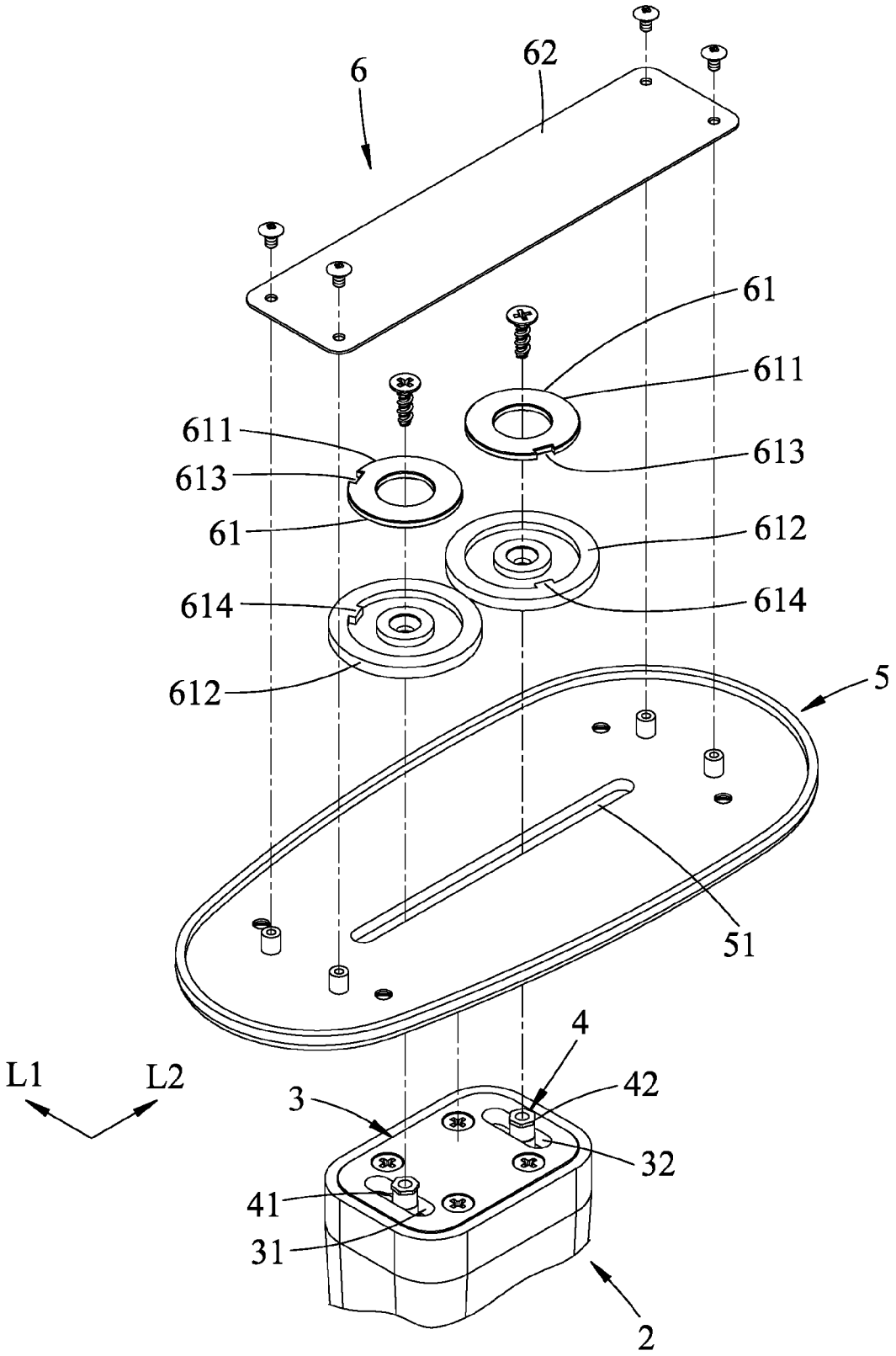
FIG. 3 is a fragmentary, exploded perspective view of a portion of the embodiment.

Referring to FIGS. 1 to 3, an embodiment of an armrest assembly according to this disclosure is adapted to be mounted on either side of a chair (not shown), and includes a support column 2, a mounting plate 3, a pivotal unit 4, an armrest plate 5, a retaining unit 6 and a resting cushion 7.

The support column 2 is adapted to be secured at either side of a chair to have a predetermined height for supporting an arm of a user. The support column 2 has a recessed upper portion 20 facing upwardly.

The mounting plate 3 is disposed on the support column 2, and is fixedly fitted to the recessed upper portion 20 in this embodiment. The mounting plate 3 has first and second moving slots 31, 32 which are elongated in a first direction (L1). Alternatively, the first and second moving slots 31, 32 may be curved about an upright axis and face each other in a second direction (L2) that is transverse to the first direction (L1). In this embodiment, the first direction (L1) may be a left-right direction of the chair, while the second direction (L2) may be a fore-aft direction of the chair.

Figure 4:
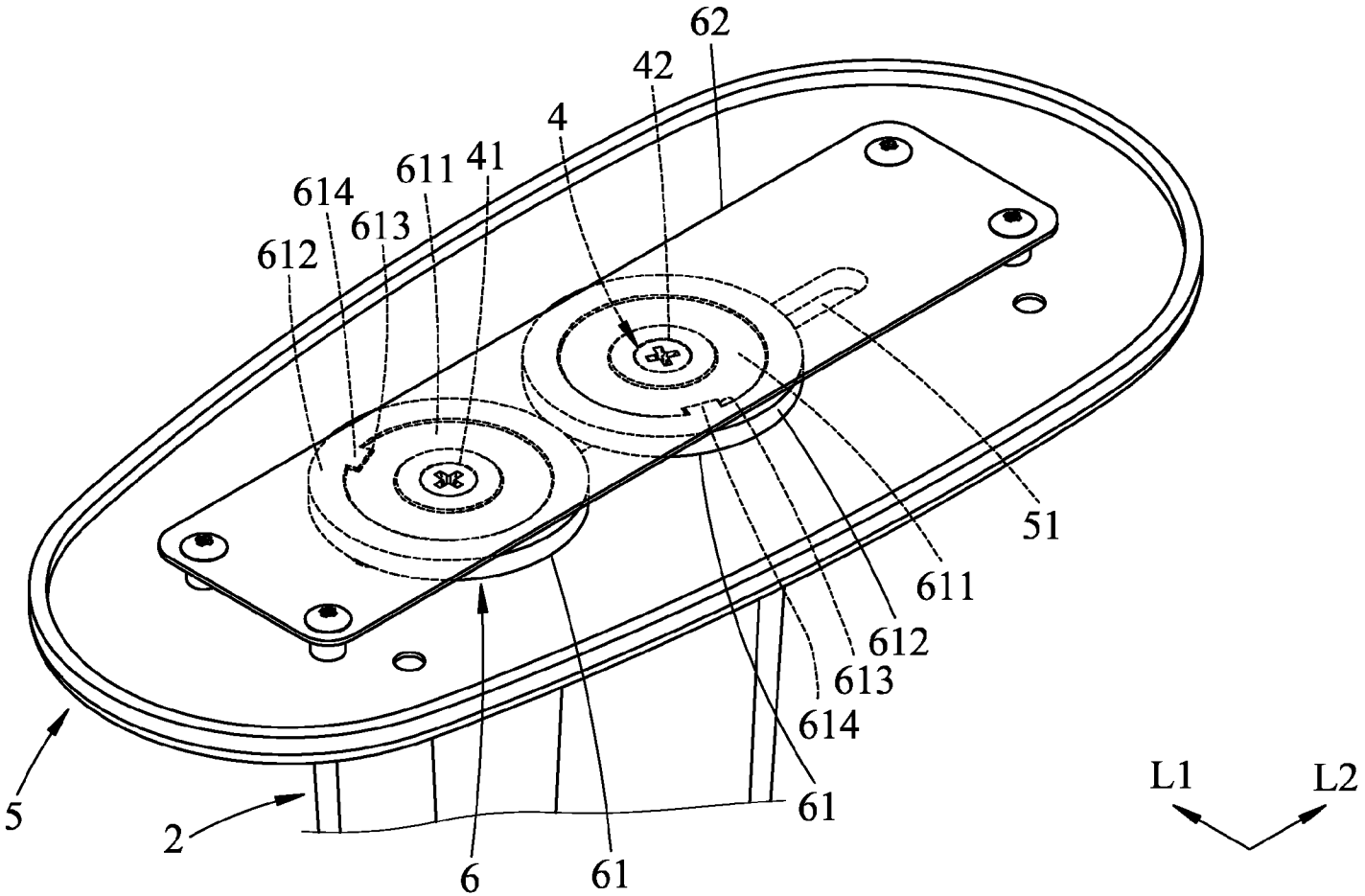
FIG. 4 is a fragmentary perspective view of the portion of the embodiment.

With reference to FIGS. 1, 3 and 4, the pivotal unit 4 includes first and second pivot shafts 41, 42 which are aligned with each other in the second direction (L2). The first pivot shaft 41 extends through the first moving slot 31 and is movable relative to the mounting plate 3 in the first direction (L1). The second pivot shaft 42 extends through the second moving slot 32 and is movable relative to the mounting plate 3 in the first direction (L1).

Figure 5:
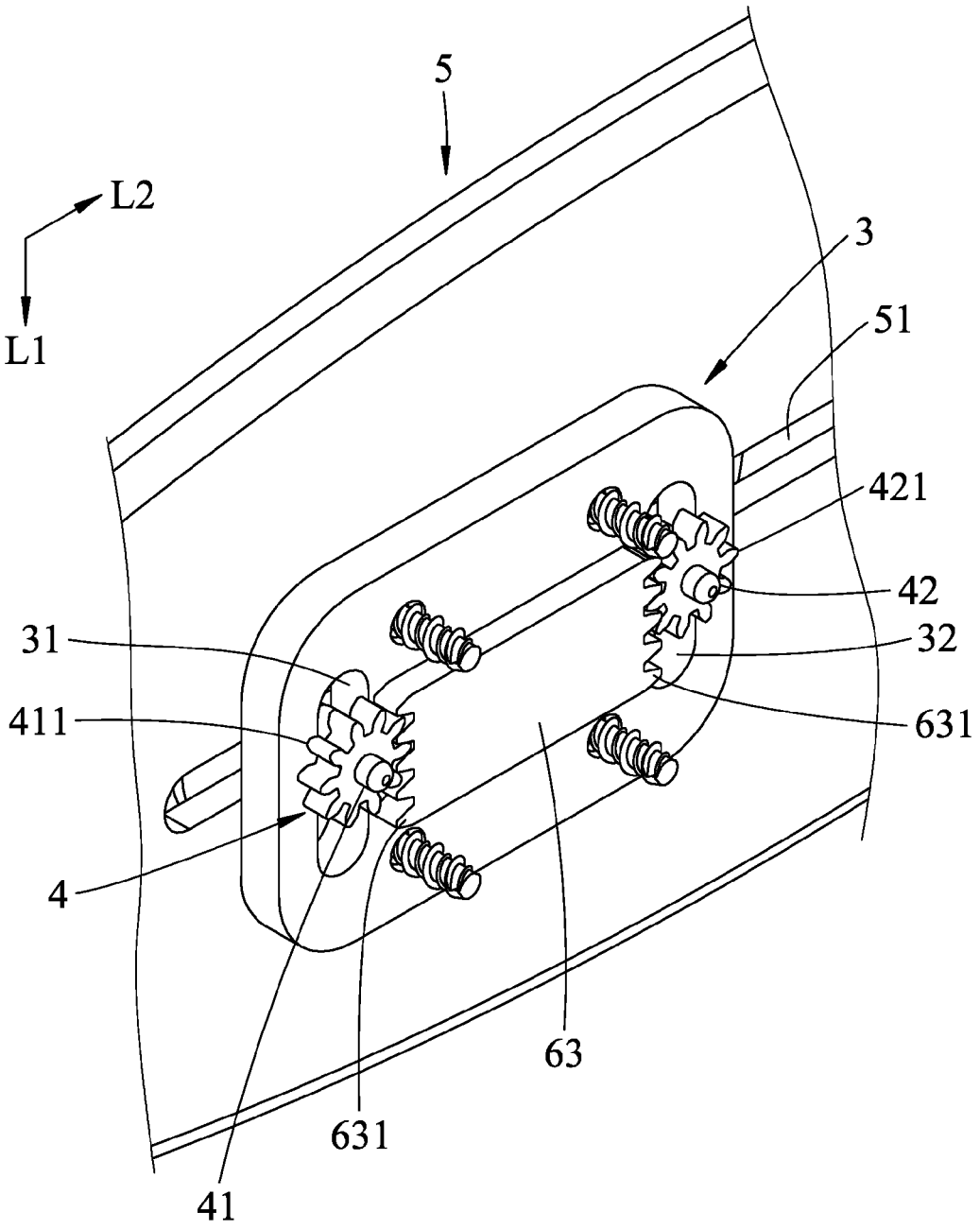
FIG. 5 is a fragmentary perspective view of another portion of the embodiment.

Referring to FIGS. 3 to 5, the first pivot shaft 41 has a first toothed portion 411 surrounding an upright axis thereof, and the second pivot shaft 42 having a second toothed portion 421 surrounding an upright axis thereof.

The armrest plate 5 has a sliding slot 51 which is elongated in the second direction (L2) and through which the first and second pivot shafts 41, 42 extend to be slidable in the second direction (L2) so as to permit the armrest plate 5 to be movable relative to the mounting plate 3 in the second direction (L2). The sliding slot 51 has a length that is larger than the distance between the first and second pivot shafts 41, 42 so as to permit movement of the armrest plate 5 in the second direction (L2). Additionally, the armrest plate 5 is turnable about the first pivot shaft 41 or the second pivot shaft 42, and is movable in the first direction (L1) relative to the mounting plate 3 along with the movement of the first and second pivot shafts 41, 42 in the first direction (L1).

Figure 6:
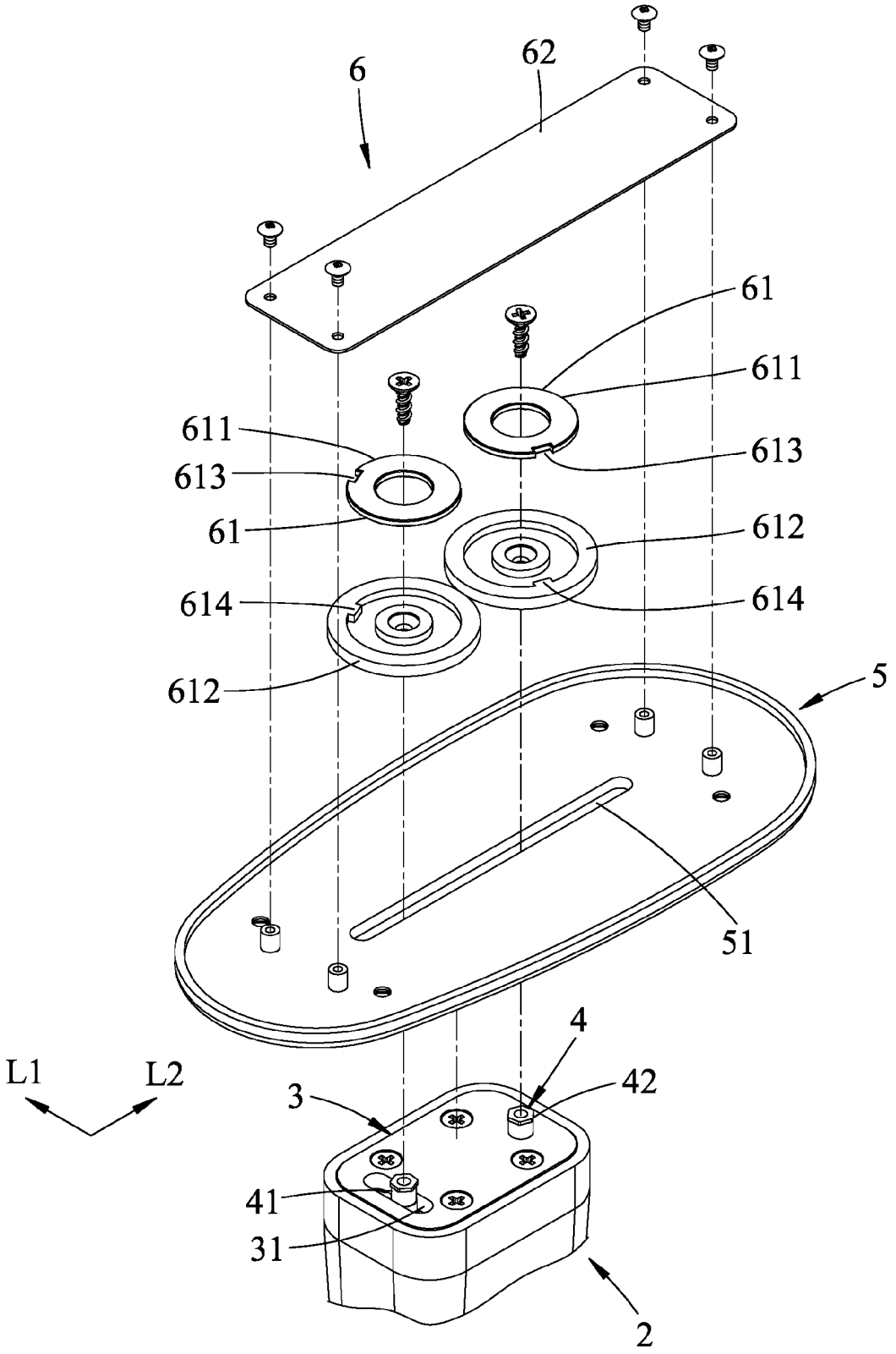
FIG. 6 is a view similar to FIG. 3, illustrating a portion of the embodiment in a modified form.

It is noted that, in this embodiment, the mounting plate 3 has the first and second sliding slots 31, 32 for allowing the first and second pivot shafts 41, 42 to be movable such that the armrest plate 5 can be moved in the fore-aft direction and the left-right direction, and can be turned about the upright axis of the first pivot shaft 41 or the upright axis of the second pivot shaft 42. In a variation, as shown in FIG. 6, the second pivot shaft 42 is fixedly mounted on the mounting plate 3 without forming of a second sliding slot such that the armrest plate 5 can be turned relative to the mounting plate 3 about the upright axis of the second pivot shaft 42.

Referring back to FIGS. 3 to 5, the retaining unit 6 includes two retaining modules 61 respectively disposed on the first and second pivot shafts 41, 42, a retaining plate 62 disposed adjacent to the retaining modules 61 to cooperate with the retaining modules 61 to produce a magnetically attractive force, and a rack plate 63 disposed below the mounting plate 3. Alternatively, the retaining unit 6 may include only one retaining module 61 disposed on either one of the first and second pivot shafts 41, 42.

When the armrest plate 5 is moved manually relative to the mounting plate 3, the retaining modules 61 are moved relative to the retaining plate 62 such that the magnetically attractive force generates resistance against the relative movement therebetween to resist a movement of the armrest plate 5 relative to the mounting plate 3. Hence, once the armrest plate 5 is moved to a desired position and orientation, the armrest plate 5 can be retained in place.

Each retaining module 61 includes a retaining member 611 which is disposed to produce the magnetically attractive force with the retaining plate 62 and which has a notch 613, and a receiving member 612 in which the retaining member 611 is fitted. The retaining member 611 is annular to be sleeved on a respective one of the first and second pivot shafts 41, 42. One of the retaining member 611 and the retaining plate 62 is made of a permanent magnet, and the other one of the retaining member 611 and the retaining plate 62 is made of a magnetically attractive material. In this embodiment, the retaining members 611 are permanent magnets, and the retaining plate 62 is a metal plate. The receiving member 612 is disposed on a respective one of the first and second pivot shafts 41, 42, is in the form of a tray, and has a protrusion 614 which is engaged in the notch 613 of the retaining member 611 for fittingly receiving the retaining member 611 such that the receiving members 612 as well as the retaining members 611 are turned together with the turning of the first and second pivot shafts 41, 42 about their upright axes.

The retaining plate 62 is securely mounted on the armrest plate 5 so as to be moved therewith.

The rack plate 63 has two rack portions 631 which are disposed on two sides thereof to respectively mesh with the first and second toothed portions 411, 421 and each of which extends in the first direction (L1).

When the first and second pivot shafts 41, 42 are moved in the first direction (L1), the first and second pivot shafts 41, 42 are rotated about their upright axes with the mesh engagement between the rack portions 631 and the first and second toothed portions 411, 421 so as to rotate the retaining modules 61 relative to the retaining plate 62, thereby increasing resistance against the movement of the armrest plate 5 relative to the mounting plate 3.

Referring to FIGS. 1 and 2, the resting cushion 7 is disposed on the armrest plate 5 for a user to rest his/her arm thereon.

Figure 7:
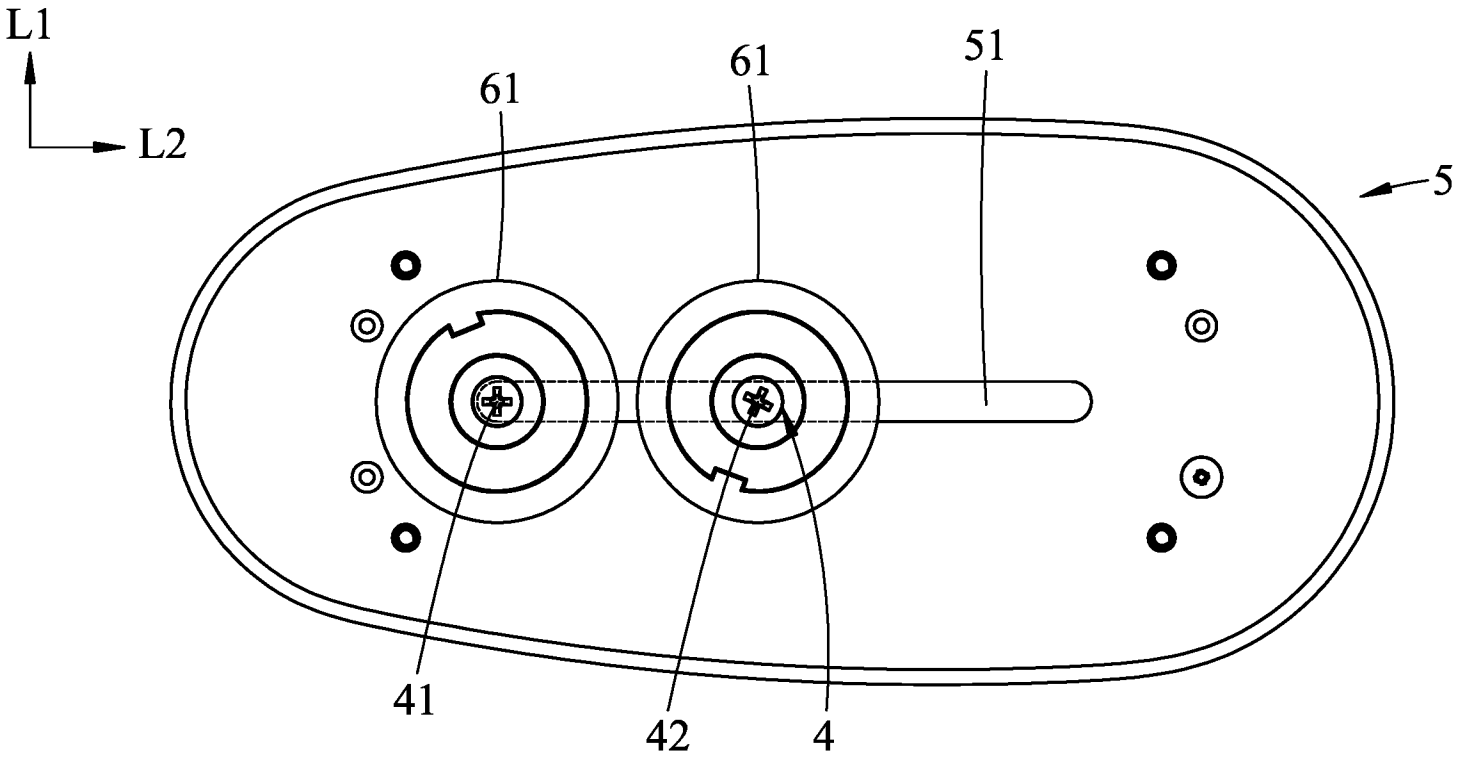
FIGS. 7 and 8 are schematic views illustrating a state when an armrest plate is moved in a fore-aft direction.
Figure 8:
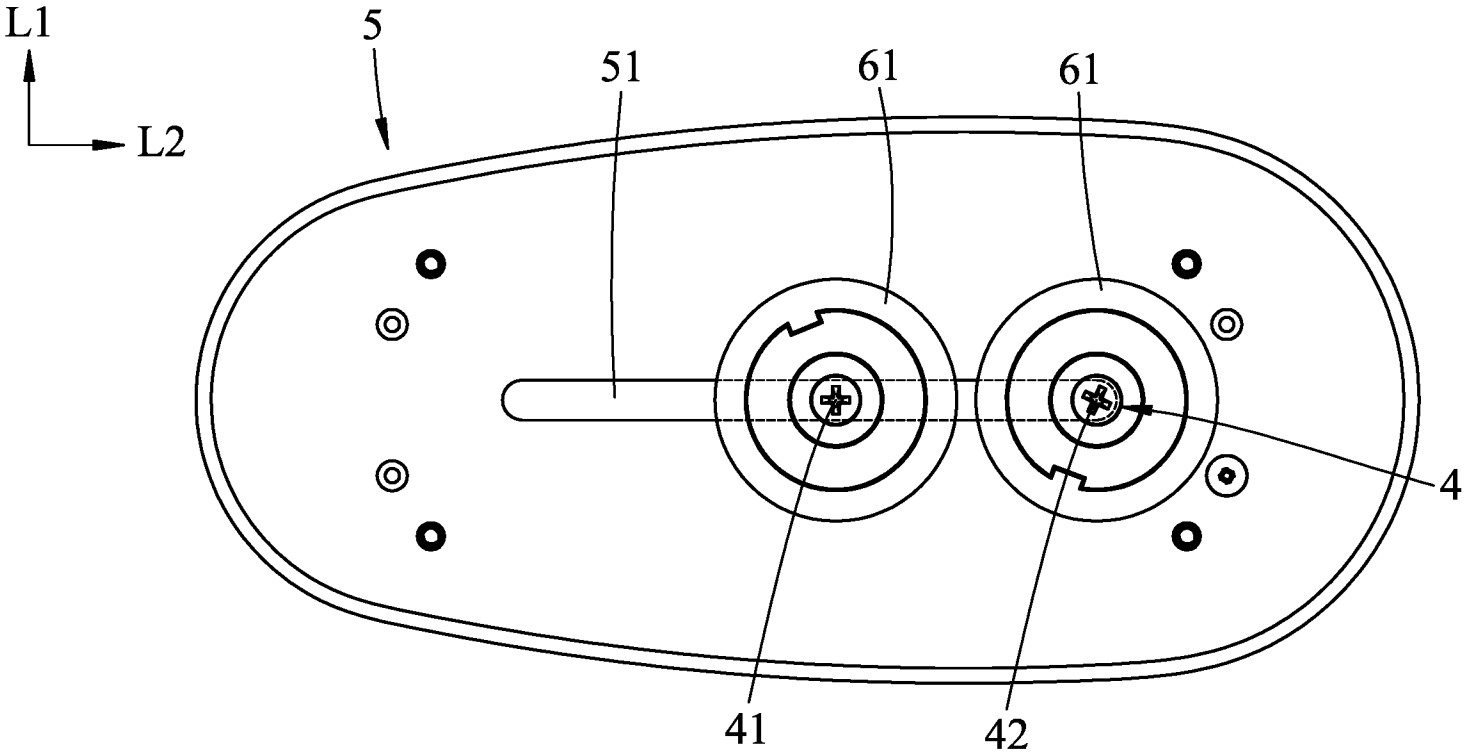

Referring to FIGS. 4, 7 and 8, when it is desired to adjust the armrest plate 5 in the fore-aft direction, a user can directly move the armrest plate 5 in the second direction (L2) by means of sliding movement of the first and second pivot shafts 41, 42 along the sliding slot 51 and against the magnetically attractive force between the retaining modules 61 and the retaining plate 62. Once stopped at a desired position in the fore-aft direction, the armrest plate 5 can be retained thereat by means of the magnetically attractive force.

Figure 9:
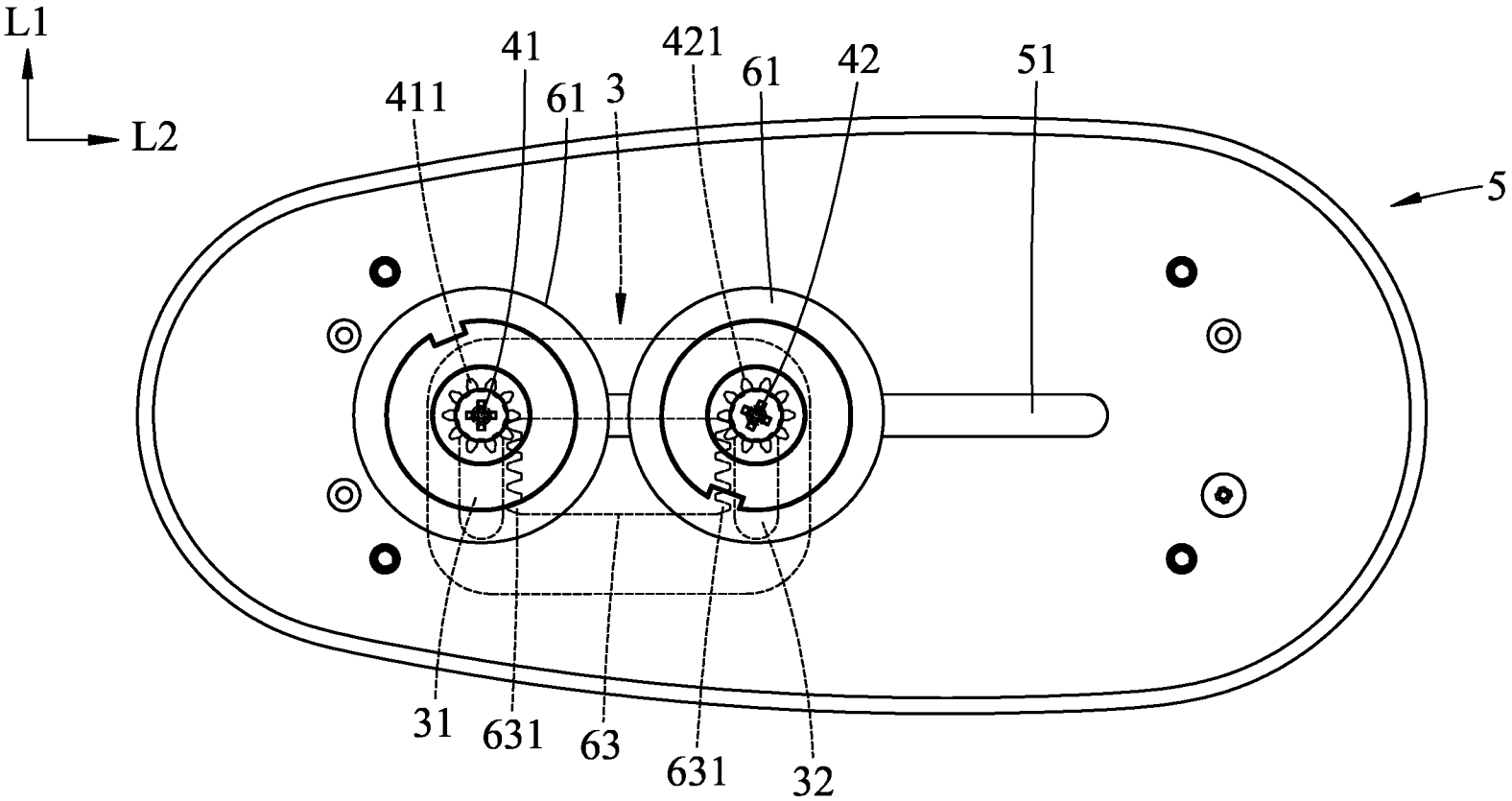
FIGS. 9 and 10 are schematic views illustrating a state when the armrest plate is moved in a left-right direction.
Figure 10:
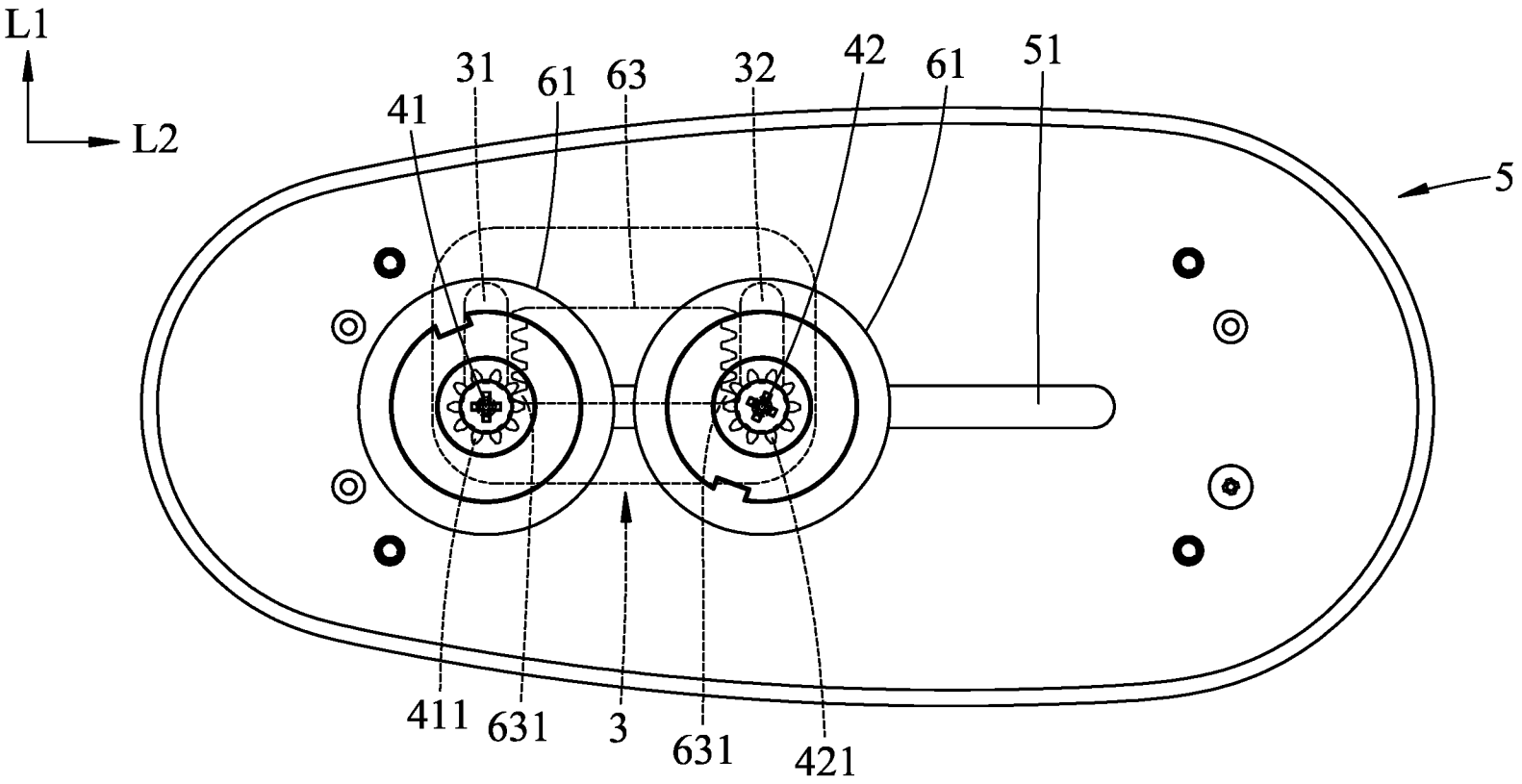

Referring to FIGS. 4, 9 and 10, similarly, when it is desired to adjust the armrest plate 5 in the left-right direction, the user can directly move the armrest plate 5 in the first direction (L1) so as to move the first and second pivot shafts 41, 42 along the first and second moving slots 31, 32. Meanwhile, the first and second pivot shafts 41, 42 are rotated about their axes so as to increase the resistance against the movement thereof in the first direction (L1) to thereby keeping movement of the first and second pivot shafts 41, 42 in a synchronous manner. Similarly, once stopped at a desired position in the left-right direction, the armrest plate 5 can be retained thereat by means of the magnetically attractive force between the retaining modules 61 and the retaining plate 62.

Figure 11:
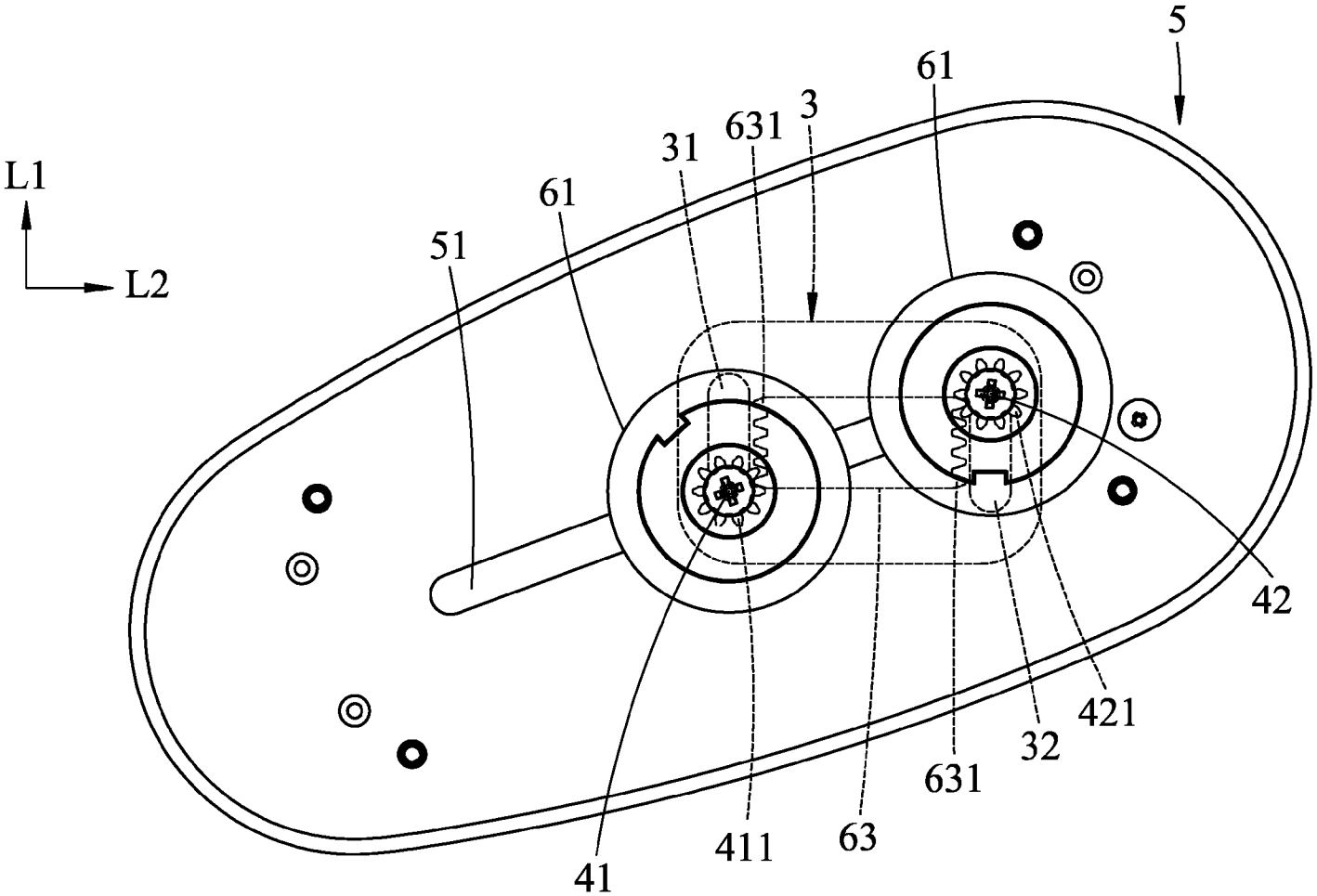
FIGS. 11 and 12 are schematic views illustrating a state when the armrest plate is turned relative to a mounting plate.
Figure 12:
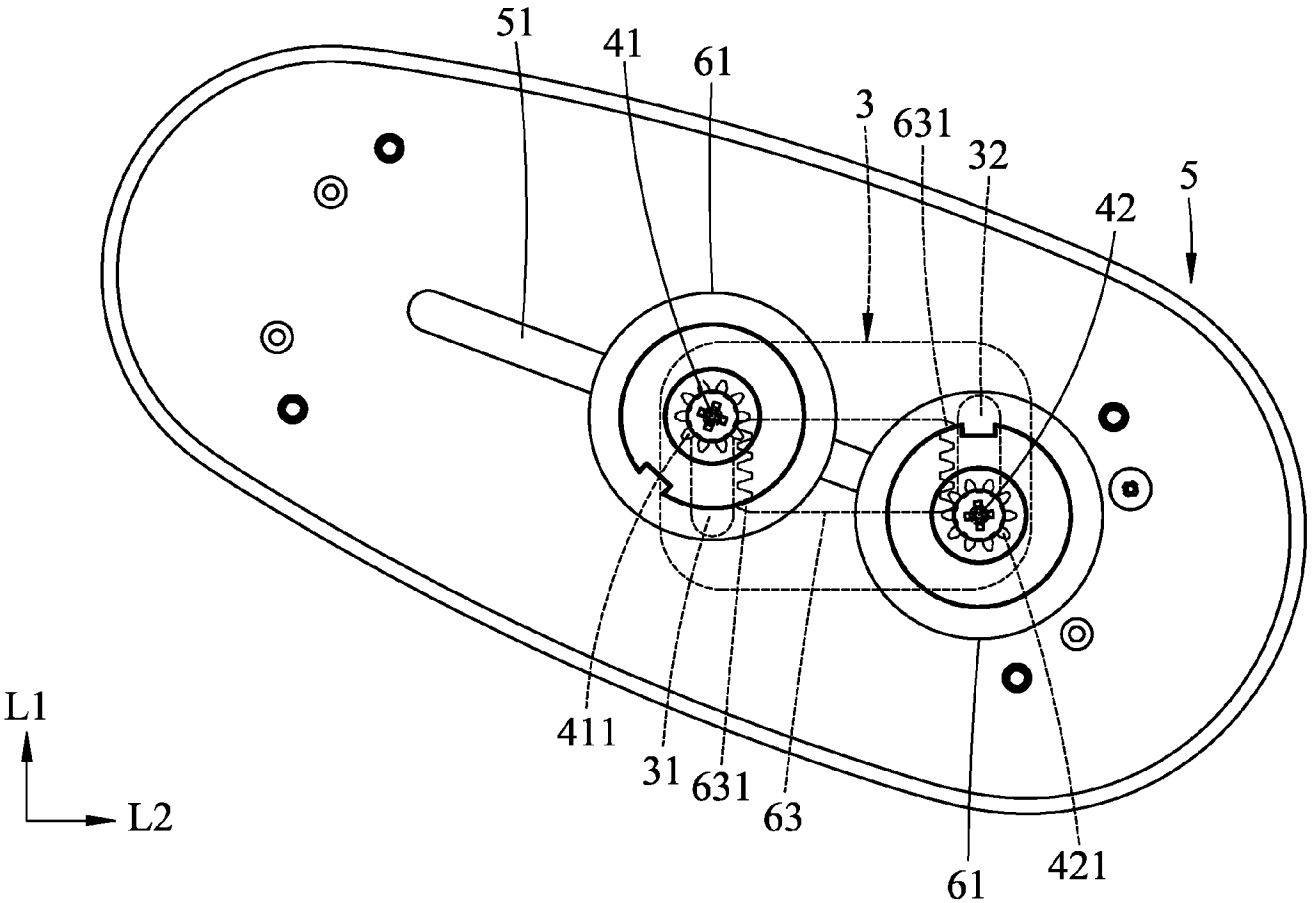

Referring to FIGS. 4, 11 and 12, when it is desired to adjust the orientation of the armrest plate 5, the user can directly turn the armrest plate 5 such that the first and second pivot shafts 41, 42 are moved along the first and second moving slots 31, 32 in opposite directions, and rotated about their axes to increase the resistance for facilitating movement of the first and second pivot shafts 41, 42 in the first direction (L1) in a synchronous manner.

As illustrated, referring to FIGS. 1 and 5, with the retaining modules 61 disposed on the pivotal unit 4 and the retaining plate 62, the armrest plate 5 can be retained by the magnetically attractive force in place at any desired position and orientation relative to the mounting plate 3, which renders the adjustment of the armrest assembly free of limitations. Moreover, the armrest assembly of this embodiment is simple in construction with a compact arrangement, and the component parts described above are concealed without affecting the outer appearance of the armrest assembly. Besides, the second pivot shaft 42 slidably and rotatably extends through the second moving slot 32 such that the armrest plate 5 can be moved more freely for changing the position and orientation of the armrest plate 5. The rack portions 631 of the rack plate 63 are disposed to respectively mesh with the first and second toothed portions 411, 421 of the first and second pivot shafts 41, 42 to permit rotation of the first and second pivot shafts 41, 42 along with the movement thereof in the first direction (L1), thereby facilitating synchronous movement of the first and second pivot shafts 41, 42 in the first direction (L1) without misalignment issue. Alternatively, the rack portions 631 may be formed on the mounting plate 3 and respectively extend along the first and second moving slots 31, 32.

Figure 13:
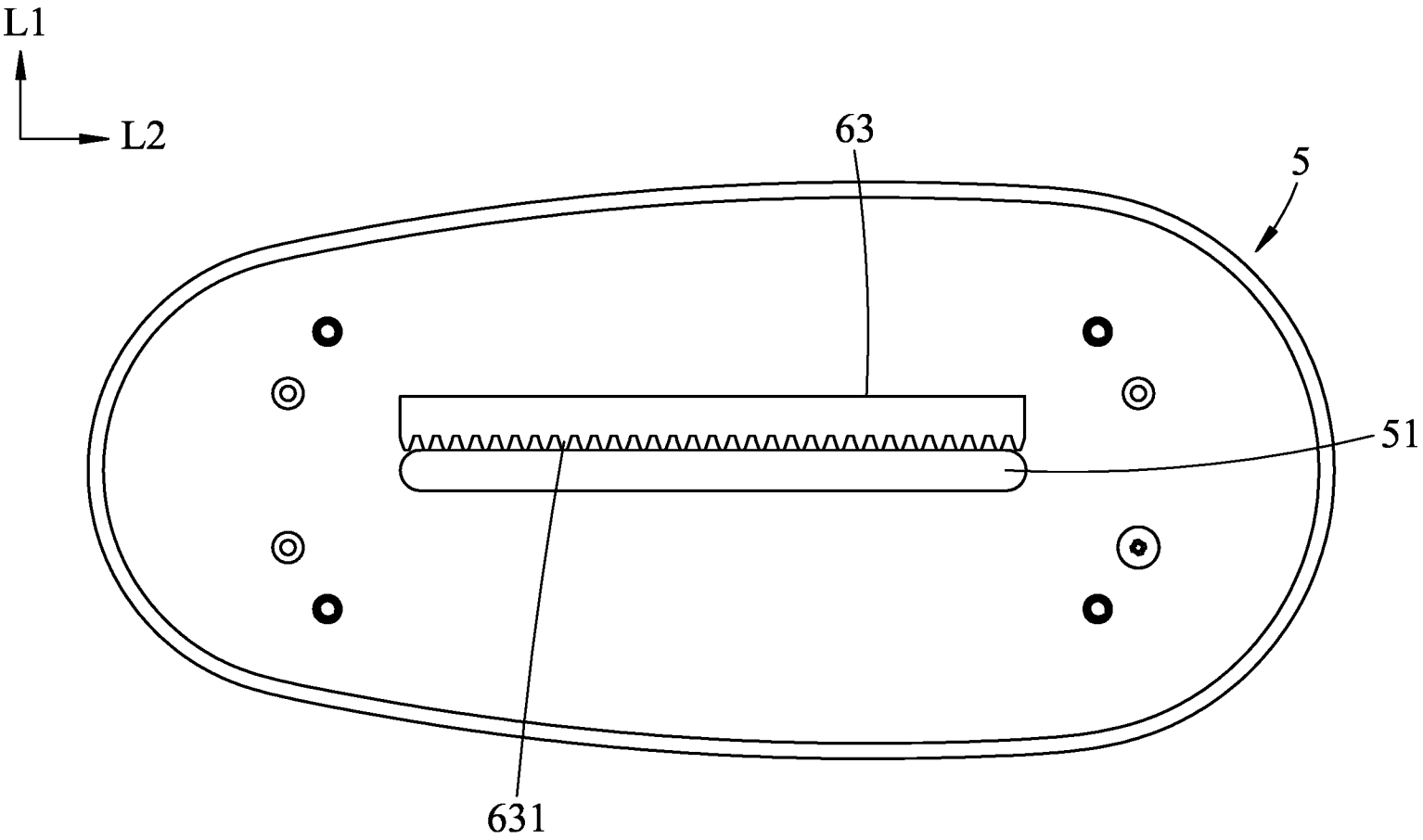
FIG. 13 is a schematic view of a rack plate of the embodiment in a modified form.

Furthermore, in this embodiment, the retaining plate 62 is secured on the armrest plate 5 adjacent to the retaining modules 61 so as to generate the resistance against the movement of the armrest plate 5 in the second direction (L2). In this case, the rack portions 631 are disposed to extend in the first direction (L1) so as to generate the resistance against the movement of the first and second pivot shafts 41, 42 in the first direction (L1). In a variation, the retaining plate 62 may be secured on the mounting plate 3 and adjacent to the retaining modules 61 so as to generate a resistance against the movement of the first and second pivot shafts 41, 42 in the first direction (L1). Also, movements of the first and second pivot shafts 41, 42 relative to the armrest plate 5 in the second direction (L2) result in rotation of the first and second pivot shafts 41, 42 about their axes so as to rotate the retaining modules 61 relative to the retaining plate 62. Further in this case, as shown in FIG. 13, a rack plate 63 is disposed on the armrest plate 5 and has a rack portion 631 which extends in the second direction (L2) along the sliding slot 51 and which meshes with the first and second toothed portions 411, 421 so as to generate the resistance against the movement of the pivot shafts 41, 42 in the second direction (L2).

Referring to FIGS. 1 and 5, the retaining members 611 are annular to respectively surround the first and second pivot shafts 41, 42 so that the magnetically attractive force generated is uniformly and symmetrically distributed, which renders the rotation of the first and second pivot shafts 41, 42 with an increased stability for enhancing operability of the armrest assembly.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. An armrest assembly comprising:

a support column;

a mounting plate disposed on said support column, and having a first moving slot which is elongated in a first direction;

a pivotal unit including first and second pivot shafts which are aligned with each other in a second direction that is transverse to the first direction, said first pivot shaft extending through said first moving slot and movable relative to said mounting plate in the first direction, said second pivot shaft being disposed on said mounting plate;

an armrest plate having a sliding slot which is elongated in the second direction and through which said first and second pivot shafts extend to be slidable in the second direction so as to permit said armrest plate to be movable relative to said mounting plate in the second direction and to be turnable about said second pivot shaft; and a retaining unit including at least one retaining module which is mounted on said pivotal unit, and a retaining plate which is disposed adjacent to said retaining module and which is configured to cooperate with said retaining module to produce a magnetically attractive force that generates resistance against a relative movement between said retaining module and said retaining plate to resist a movement of said armrest plate relative to said mounting plate.

2. The armrest assembly as claimed in claim 1, wherein said mounting plate has a second moving slot elongated in the first direction, said second pivot shaft extending through said second moving slot and being movable relative to said mounting plate in the first direction so as to permit said armrest plate to be movable relative to said mounting plate in the first direction and to be turnable about said first pivot shaft.

3. The armrest assembly as claimed in claim 2, wherein said retaining unit includes two of said retaining modules which are respectively disposed on said first and second pivot shafts, said retaining plate being disposed on one of said armrest plate and said mounting plate and adjacent to said retaining modules.

4. The armrest assembly as claimed in claim 3, wherein said retaining plate is secured on said armrest plate, said first pivot shaft having a first toothed portion surrounding an axis thereof, said second pivot shaft having a second toothed portion surrounding an axis thereof, said retaining unit further including two rack portions which are disposed to respectively mesh with said first and second toothed portions and each of which extends in the first direction such that movements of said first and second pivot shafts in the first direction result in rotation of said first and second pivot shafts about their axes so as to rotate said retaining modules relative to said retaining plate.

5. The armrest assembly as claimed in claim 3, wherein said retaining plate is secured on said mounting plate, said first pivot shaft having a first toothed portion surrounding an axis thereof, said second pivot shaft having a second toothed portion surrounding an axis thereof, said retaining unit further including a rack portion which extends in the second direction and which meshes with said first and second toothed portions such that movements of said first and second pivot shafts in the second direction result in rotation of said first and second pivot shafts about their axes so as to rotate said retaining modules relative to said retaining plate.

6. The armrest assembly as claimed in claim 1, wherein said at least one retaining module is disposed on said first pivot shaft.

7. The armrest assembly as claimed in claim 6, wherein said retaining plate is secured on said armrest plate, said first pivot shaft having a first toothed portion surrounding an axis thereof, said retaining unit further including a rack portion which is disposed to mesh with said first toothed portion and which extends in the first direction such that a movement of said first pivot shaft in the first direction results in rotation of said first pivot shaft about their axes so as to rotate said retaining module relative to said retaining plate.

8. The armrest assembly as claimed in claim 6, wherein said retaining plate is secured on said mounting plate, said first pivot shaft having a first toothed portion surrounding an axis thereof, said retaining unit further including a rack portion which is disposed to mesh with said first toothed portions and which extends in the second direction such that a movement of said first pivot shaft in the first direction results in rotation of said first pivot shaft about their axes so as to rotate said retaining module relative to said retaining plate.

9. The armrest assembly as claimed in claim 1, wherein said retaining module includes a retaining member which is disposed to produce a magnetically attractive force with said retaining plate, one of said retaining member and said retaining plate being made of a permanent magnet, the other one of said retaining member and said retaining plate being made of a magnetically attractive material.

10. The armrest assembly as claimed in claim 1, wherein said retaining module includes a retaining member which is sleeved on said first pivot shaft to produce a magnetically attractive force with said retaining plate, and a receiving member which is disposed on said first pivot shaft and in which said retaining member is fitted, said first pivot shaft being rotatable relative to said first moving slot about an axis thereof to rotate said receiving and retaining members relative to said retaining plate.

* * * * *